US006053021A

United States Patent [19]

Bünten et al.

[11] Patent Number: 6,053,021

[45] Date of Patent: Apr. 25, 2000

[54] ROLLING MILL

[75] Inventors: Rolf Bünten, Düsseldorf; Ulrich Genge, Ratingen, both of Germany

[73] Assignee: Mannesmann AG, Düsseldorf, Germany

[21] Appl. No.: 09/344,834

[22] Filed: Jun. 25, 1999

[30] Foreign Application Priority Data

Jun. 26, 1998 [DE] Germany ..... 198 30 033

[51] Int. Cl.[7] ..... B21B 31/07

[52] U.S. Cl. ..... 72/247

[58] Field of Search ..... 72/241.2, 241.4, 72/241.6, 241.8, 242.2, 242.4, 252.5, 243.6

[56] References Cited

U.S. PATENT DOCUMENTS 3,140,512 7/1964 Hausman ..... 72/252.5
4,823,585 4/1989 Hishminuma et al. ..... 72/247

FOREIGN PATENT DOCUMENTS 200734 9/1906 Germany .
533685 9/1931 Germany .

*Primary Examiner*—Rodney A Butler
*Attorney, Agent, or Firm*—Cohen, Pontani, Lieberman & Pavane

[57] ABSTRACT

A rolling mill, especially a hot flat-rolling mill, comprises a pair of working rolls which are supported either directly or via intermediate rolls on a pair of supporting rolls, the pair of working rolls being mutually axially displaceable. To permit far-reaching influencing and compensation of the bending of the rolls which occurs due to thermal cambering and under load, and of the roll gap changes which are produced thereby, and thus to achieve optimum profile control and flatness control of this rolling mill, each of the mutually axially displaceable working rolls comprises a hollow roll with a cavity designed to be rotationally symmetrical in relation to a longitudinal axis of the roll and asymmetrical in relation to an imaginary transverse plane inter-secting the longitudinal axis at a center of the roll crown. The first and second working rolls include identically designed cavities turned through 180° with respect to each other.

21 Claims, 5 Drawing Sheets

ROLLING MILL

BACKGROUND OF THE INVENTION

1. Field of the Invention

The invention relates to a rolling mill, especially a hot flat-rolling mill, having a pair of working rolls supported on a corresponding pair of supporting rolls either directly or via intermediate rolls and mutually axially displaceable to compensate for unevenness over the width of the material being rolled.

2. Description of the Related Art A prior art rolling mill of the generic type is known, for example, from European Patent 0 049 798. The rolls of one pair of this known rolling mill are provided with curved contours extending over the entire crowned length of both rolls and have a shape such that the two crowned contours complement each other exclusively in a specific relative axial position of these rolls. In a preferred embodiment in the prior art according to this reference, the two rolls of a pair are ground to be identically S-shaped and, in their installed position, are arranged to be turned through 180° with respect to each other.

In the rolling of hot strip, this prior art rolling mill is intended to counteract thickness errors which occur over the width of the material to be rolled and which make the production of flat strip with a predefined strip profile more difficult. Thickness errors of this type are produced on the one hand because the rolls bend over their length under the rolling load and, on the other hand, by expansion of the rolls when they are in contact with the hot strip, which manifests itself through an increasing crown (thermal crown). Both the bending of the rolls over their length and the thermal crown alter the roll gap profile which causes—in accordance with the law of constant volume throughput per unit time—different strip lengthening to occur over the width of the material to be rolled which evidences itself as a waviness or saber formation in the strip.

A known solution for addressing this problem is to use contoured rolls. The contoured rolls are mutually axially displaced, given an appropriate ground roll crown, which enables the setting of different roll gap cross sections and also to compensate for the changes in the roll crown. Thus, for example, an S-shaped ground contour of the rolls, and the installed position of the opposite roll, rotated through 180°, in the prior art, make it possible, by mutual axial displacement of the rolls, to set both an equidistant and a convex or concave roll gap profile.

With the known solution, a clear advantage was achieved in that a radius of curvature was selected such that bending of the rolls under the rolling force was compensated for by the convex camber so that a flat strip was produced in the ideal case. However, the disadvantage of this solution is that the shape of the convex camber applies only to a specific bend caused by a specific rolling force and width of material to be rolled. Thus, if the rolling force or the width of the material to be rolled changed, different ground-crown rolls had to be used with a specific convex shape drawn to the particular application. In addition, this known solution does not compensate for the thermal expansion of the rolls.

The prior art solution using S-shaped contoured rolls permits a certain compensation of the changes in the roll crown which arise under the influences of load and temperature. However, it has the disadvantage that the curved roll crowns change as a result of thermal influences and wear and are difficult to produce. The curvature are asymmetrical in relation to the roll center, given essentially symmetrical bending of the rolls and a symmetrical strip, and in addition to the thermal expansion, the asymmetry of the curve causes asymmetrical wear which cannot be compensated for by displacing the rolls.

SUMMARY OF THE INVENTION

The object of the present invention is to provide a hot flat-rolling mill having cylindrically or symmetrically ground working rolls which permits far-reaching influencing and compensation for the bending of the working rolls which occurs under load and as a result of thermal cambering and for the roll gap changes which are produced by the bending of the rolls, thereby allowing optimum profile control and flatness control of the rolling mill.

To achieve the object, the invention proposes that the displaceable pair of working rolls are designed as a hollow rolls with a cavity designed to be rotationally symmetrical in relation to a longitudinal axis of the working roll and asymmetrical in relation to an imaginary transverse plane intersecting the working roll longitudinal axis at the center of the roll crown. The displaceable pair of working rolls are installed with identically designed cavities rotated 180° with respect to each other.

Hollow working rolls have been known for a long time in connection with hot rolling mills and are described, for example, in German Patent 533 685. In that document, it was recognized that during the hot rolling of sheet metals, under conditions of contact with the material to be rolled and because of the frictional heat, more severe heating of the roll crown of the working roll occurs at the center than at the roll edge which leads to nonuniformity of the heat distribution in the working roll. The nonuniform heat distribution produces nonuniform expansions or contractions of the working roll, which change the working roll surface in a corresponding manner. To prevent this, the cited prior art patent specification proposes providing a curved cavity profile within the cylindrical working roll in which the diameter of the hollow is greater at the center than at the edge of the hollow. The curve of the cavity profile is preferably formed by a circular arc whose center is the point of intersection of the working roll center line with the central perpendicular, which corresponds to the roll axis.

In the still earlier German Patent 200 734, a description is likewise given of a hollow working roll for hot rolling mills, having a cylindrical running surface which counteracts thermal cambering of the roll by a cavity extending symmetrically with respect to the roll center.

In neither of the previously known solutions is any thought given to compensating for the bending as a result of changing rolling forces. However, compensation for this type of bending can be solved in a simple way by the working roll proposed by the present invention. In contrast to the known symmetrical cavity design, the invention proposes to arrange the cavity, which extends at least under part of the effective crown length of each working roll, asymmetrically in relation to the working roll. The cavity of the other working roll of the pair is arranged in mirror-image fashion in relation to the other roll of the pair about a transverse plane. That is, the cavity of one working roll is arranged on a position 180° from the other working roll. The pair of working rolls are mutually displaceable along their longitudinal axes. When the working rolls bend under load, the asymmetrical cavities in the rolls are arrangeable in special installed position to have the effect of an asymmetrical bending line over the length of the roll crowns, this line running in an S-shape in an appropriate cavity configuration. In a manner similar to that proposed by the generic prior art, the point-symmetrical cambers which are established at the effective roll crowns when the working rolls are mutually displaced changes the roll gap cross section as desired, and sets a roll gap profile between flat, convex and concave. At the same time, however, the cavity profile, which is selected to be asymmetrical in relation to the center of the roll crown, is not subjected to the wear of the working rolls, as is the case in the generic prior art because the sleeve of the working roll of the present invention is ground cylindrically.

According to a beneficial refinement of the invention, the working rolls are designed as hollow cylinders open at one end with one roll journal coaxially molded or fitted on the closed end. Another roll journal is coaxially inserted into the open end of the hollow cylinder. A support bearing is connected between the roll journal at the open end and the inner surface of the roll. The support bearing supports the roll journal against the inner surface of the roll. A gap, which is open toward the open end of the roll, remains radially between the inner surface of the roll and the outer surface of the roll journal and axially between the support bearing and the open end of the roll. The cavity being formed between the closed end of the roll and the roll journal inserted in the open end. In this case, the asymmetrical support of the roll by the supporting bearing, in conjunction with the cavity on one side and the gap on the other side, has the effect of producing the desired cambering of the roll under load. The production of such a roll is simple but functional.

The boundary of the cavity profile of rolls according to the invention may be formed by an open polygon of straight lines, but according to the invention it is advantageous to use curved contours, by means of which the roll is provided with a roll sleeve which has a different thickness over its length. This results in the desired bending behavior of the roll both under rolling load and under thermal conditions, in accordance with the selected curvature or the roll sleeve diameter resulting from this.

In a preferred embodiment, provision is made for the curved contour to be composed of a convex and a concave section. These two sections of the cavity profile, given an installed position of the two rolls which is rotated through 180°, permit a roll crown profile to be set particularly simply by mutual displacement of the rolls, in which the roll crown contours complement each other in one displaced position of the roll crown and change the roll gap from concave to convex in other displaced positions.

Within the scope of the invention, however, it is also conceivable for the curved contour to extend over a portion of an otherwise cylindrical roll. It is thus possible for both concave and convex sections on, for example, one half of a roll, or part of half of a roll, to alternate with cylindrical sections of the other half of the roll.

It is particularly advantageous if the curved cavity contour is formed by a polynomial with an odd exponent, preferably with a polynomial of third order. The polynomial of third order has the property that, under symmetrical bending of the rolls, it does not change with regard to the point symmetry.

In another beneficial refinement of the invention, provision is made for the cavity profile in the region of the effective crown length to be bounded by a stepped contour. Stepped contours can be produced more easily and to an extent fulfill the desired purpose in the same way as a curved contour.

In a particularly beneficial refinement of the invention, provision is made for the stepped contour to be formed by rings which have identical external diameters and different internal diameters and are inserted into a cylindrical sleeve element, coaxially with the mid-axis of the rolls. These rings may be inserted into a sleeve with a cylindrical interior and may, if required, be replaced by other rings for the purpose of changing the cavity profile.

In addition, it is conceivable for the sleeve element and rings to be made of different materials, so that, for example, the sleeve element can be produced from a particularly wear-resistant material and the rings from a resilient material.

In addition, according to another feature of the invention, it is conceivable to fill the cavity of the roll with a material of a different strength and/or different thermal conductivity. It is conceivable that, as early as during the production, that is to say during the casting, of the roll, a sleeve element made of a roll material is paired with a heat-resistant core of another material, which meets the requirements of thermal and mechanical bending. In one refinement of the invention, it is also conceivable to introduce coolant into the cavities present in the roll, in order in this way additionally to influence the thermal changes in the roll during the rolling operation.

In the solution in which the sleeve of the roll and the inner part bounding the cavity are designed to be separate, the sleeve may comprise a replaceable wearing element.

Although the special advantage of the present invention resides in the use of a cylindrical roll crown, which can easily be reground or replaced in the event of wear, it is also conceivable to provide the cylindrical roll crown with a known symmetrical camber, with which some of the bending of the rolls can be compensated for. The regrinding of a symmetrically cambered roll is simpler than that of a ground S-shaped contoured crowned roll surface, so that in that case, too, the advantages of the invention come fully to fruition.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings.

In the drawings, wherein like reference characters denote similar elements throughout the several views.

DETAILED DESCRIPTION OF THE PRESENTLY PREFERRED EMBODIMENTS

Figure 1:
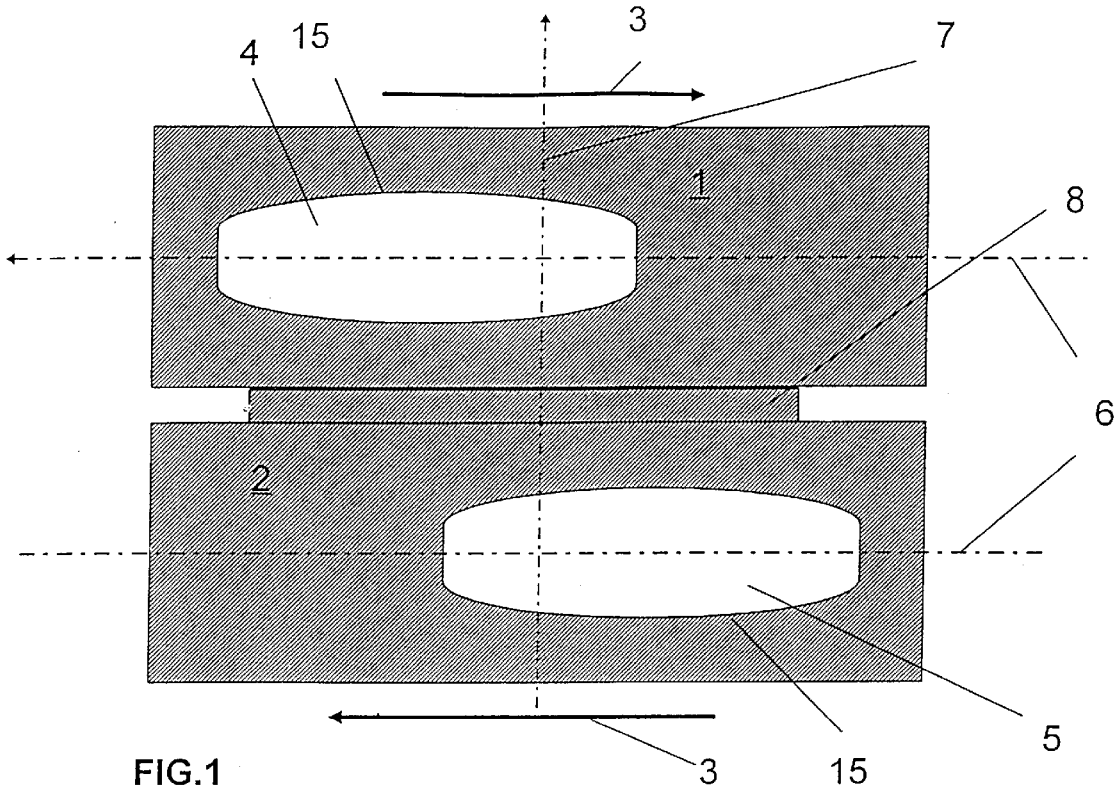
FIG. 1 is a cross-sectional view of the working rolls of the roll mill of FIG. 1*a* through line I—I.
Figure 1A:
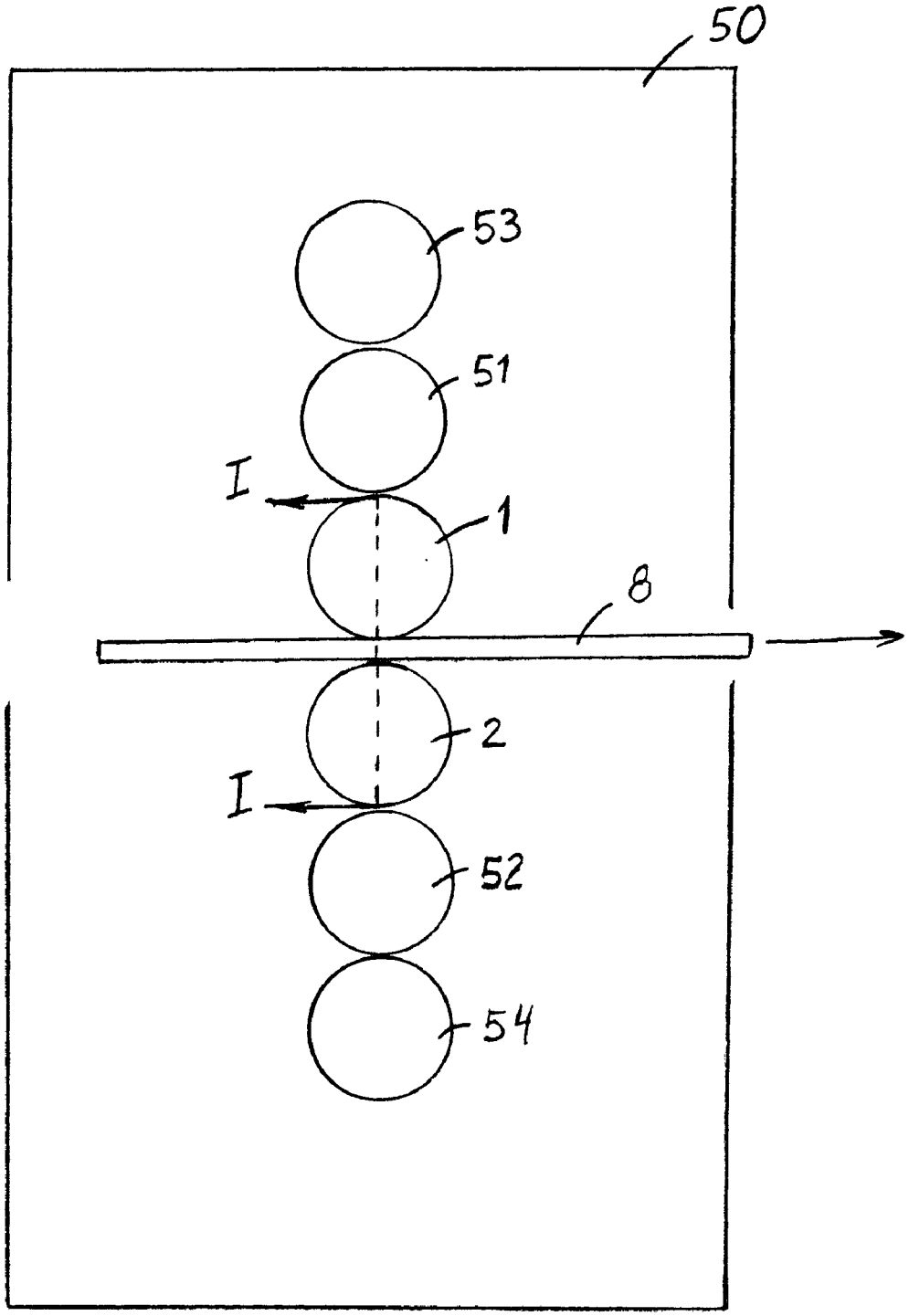
FIG. 1*a* shows a schematic side view of a roll mill according to the present invention.

FIG. 1*a* shows a roll mill 50 according to the present invention including a pair of working rolls 1, 2 including a top working roll 1 and a bottom working roll 2 for flattening a work piece 8. The two working rolls 1, 2 are shown as being supported by support rolls 53, 54 via intermediate rolls 51, 52. However, the working rolls 1, 2 may also be directly supported on the support rolls 53, 54. FIG. 1 shows a cross section of the pair of working rolls 1, 2. Each of the two working rolls has a longitudinal axis 6. As indicated by arrows 3, the two working rolls 1, 2 are mutually displaceable along their respective longitudinal axes 6 in opposing directions. The two working rolls 1 and 2 of the pair are designed as hollow rolls respectively having cavities 4 and 5 which are designed to be rotationally symmetrical in relation to the roll longitudinal axis 6 of each working roll 1, 2 and asymmetrical in relation to an imaginary transverse plane 7 intersecting the roll longitudinal axis at the center of the roll crown. Each of the cavities 4, 5 has a curved contour 15. The working rolls 1, 2 are installed in such a way that the identically designed cavities 4 and 5 are installed turned through 180° in relation to each other, so that during the rolling operation a deliberately asymmetrical deformation of the rolls 1 and 2 results and, together with the displacement of the working rolls 1 and 2 in the direction 3, results in a variable roll gap.

As FIG. 1 illustrates, the cavities 4 and 5 in the working rolls 1 and 2 may extend over only part of the effective roll crown length which results from the area of contact with the material 8 to be rolled. Alternatively, the cavities 4 and 5 may extend over the entire effective crown length.

A wide variety of diverse shapes of the cavities 4, 5 in the working rolls 1, 2 are usable, as evidenced by the various embodiments of the cavities 4, 5 indicated by way of example in FIGS. 2 to 11. For reasons of simplification, only the top working roll 1 is shown in FIGS. 2 to 11. The bottom working roll 2 is installed in the roll mill at a position that is turned through 180° relative to the top working roll 1 in each case, as is illustrated only in FIG. 1, and is paired with the illustrated top working roll 1.

Figure 2:
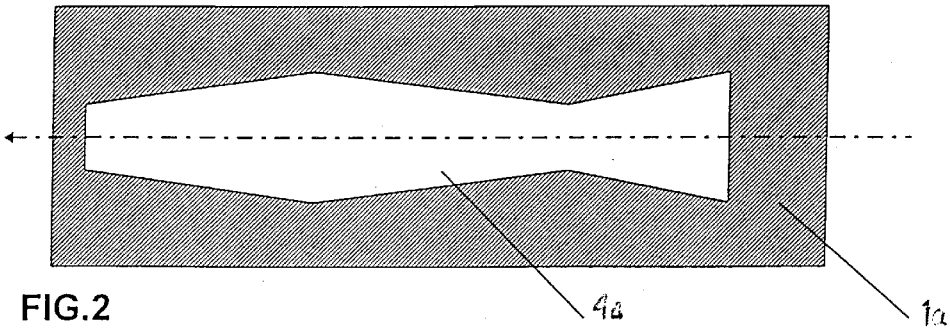
FIGS. 2–11 are cross-sectional views showing other embodiments of working rolls which may be used in the roll mill of FIG. 1.

In FIG. 2, a cavity 4*a* in a top working roll 1*a* is made of straight sections which bound the cavity profile formed as a body of rotation. The shape of the cavity 4*a* includes three truncated cones arranged so that two of the truncated cones meet at their bases and the third truncated cone has a top surface which meets the top surface of the adjacent truncated cone.

Figure 3:
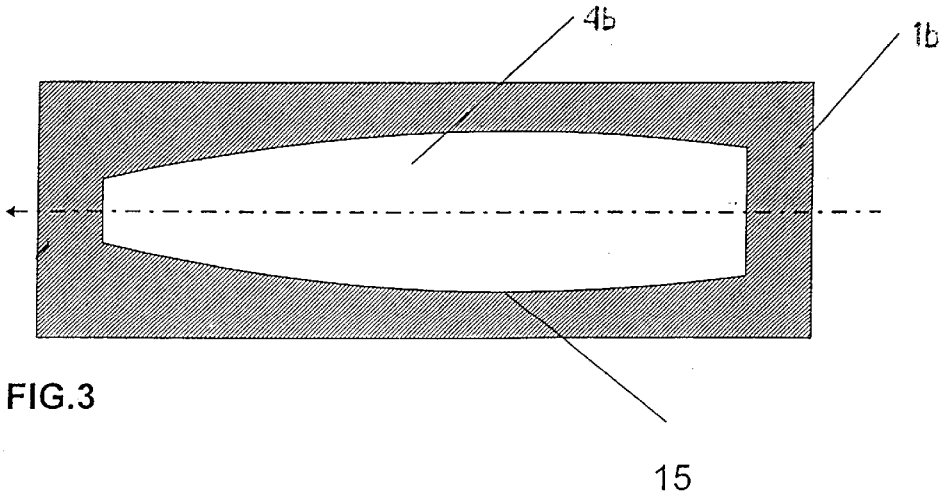

However, it is equally conceivable to bound a cavity 4*b* in the roll 1*b* by a curved contour 15*b*, as shown in FIG. 3. In this embodiment, the contour 15*b* is rotationally symmetrical with respect to the roll longitudinal axis and asymmetrical with respect to the imaginary transverse plane 7 intersecting the roll longitudinal axis 6*b*. The curved contour 15*b* may be selected as desired and may be a section of a circular function, of a polynomial or of a helix.

Figure 4:
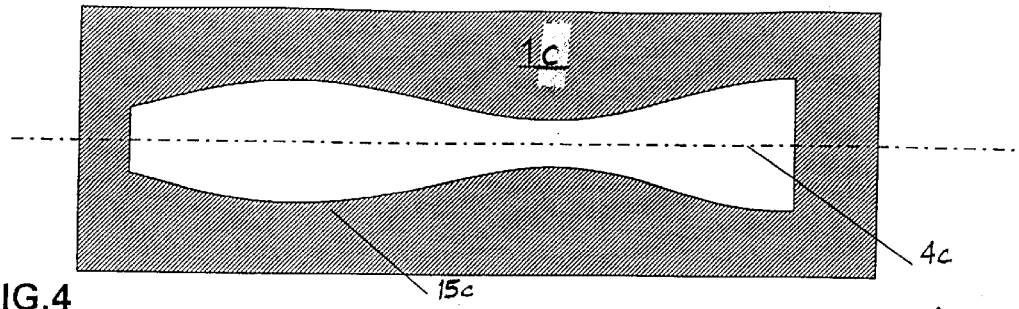
Figure 5:
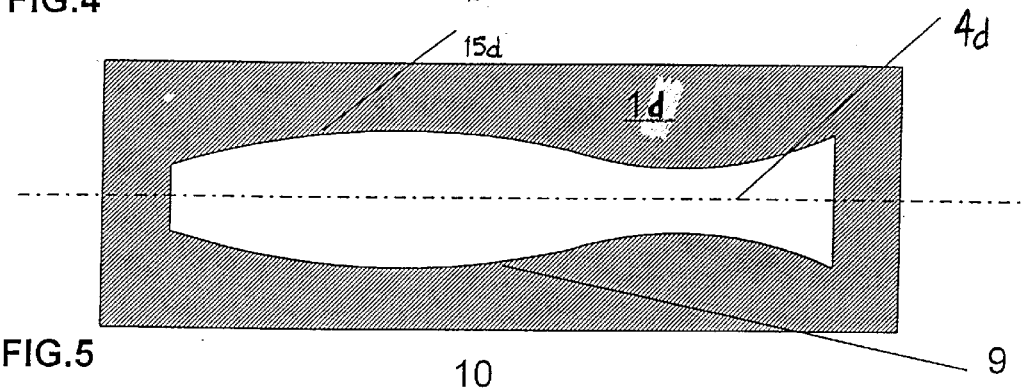

Beneficial conditions result if, as illustrated in FIG. 4, a curved contour 15*c* of a cavity 4*c* comprises a convex and a concave section, of which each section can be determined by a circular radius. It is likewise beneficial if, as illustrated in FIG. 5, the curved contour 15*d* is formed by a polynomial with an odd exponent, preferably a polynomial of third order, as illustrated and indicated at 9.

Figure 6:
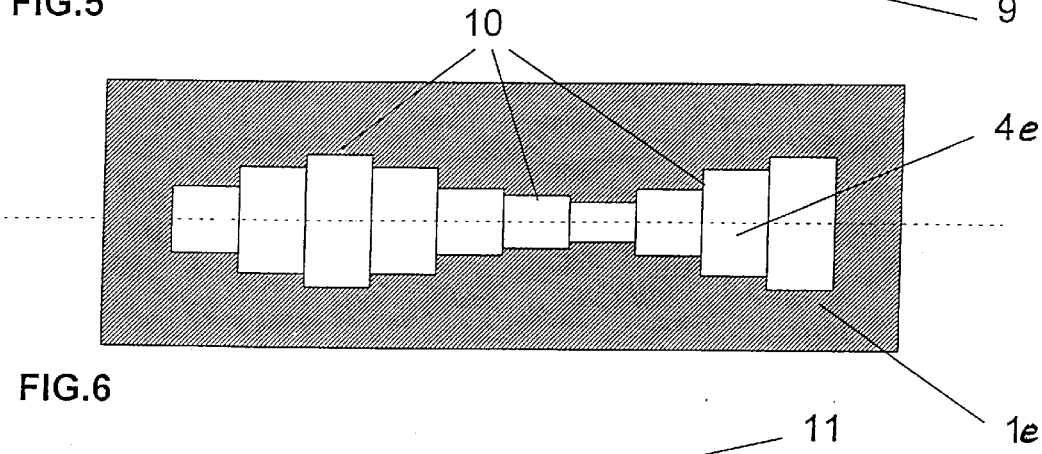

Another option for designing the cavity 4*e* of the roll 1*e* according to the invention is to bound the cavities in the region of the effective crown length with stepped contours 10, as illustrated in FIG. 6. These stepped contours 10, may be produced by undercuts.

Figure 7:
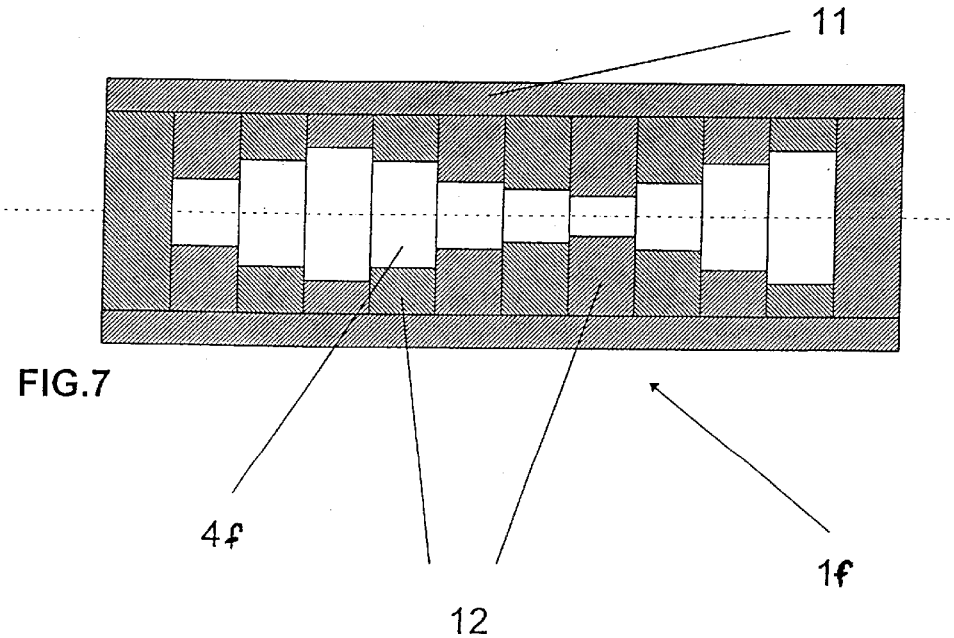

Alternatively, a simpler manufacture of the stepped contours is permitted by the fact that, as illustrated in FIG. 7, use is made of a cylindrical sleeve element 11, into which rings 12 which have identical external diameters and different internal diameters are inserted. In addition, this variant has the advantage that the cylindrical sleeve element 11 is replaceable, while the rings 12 are reusable with a new cylindrical sleeve element 11. The plural rings 12 may comprise a different material of composition than the cylindrical sleeve element.

Figure 8:
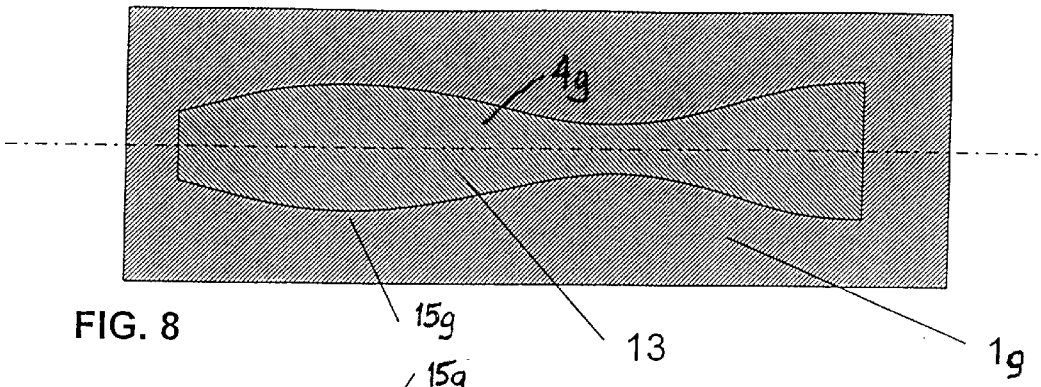
Figure 9:
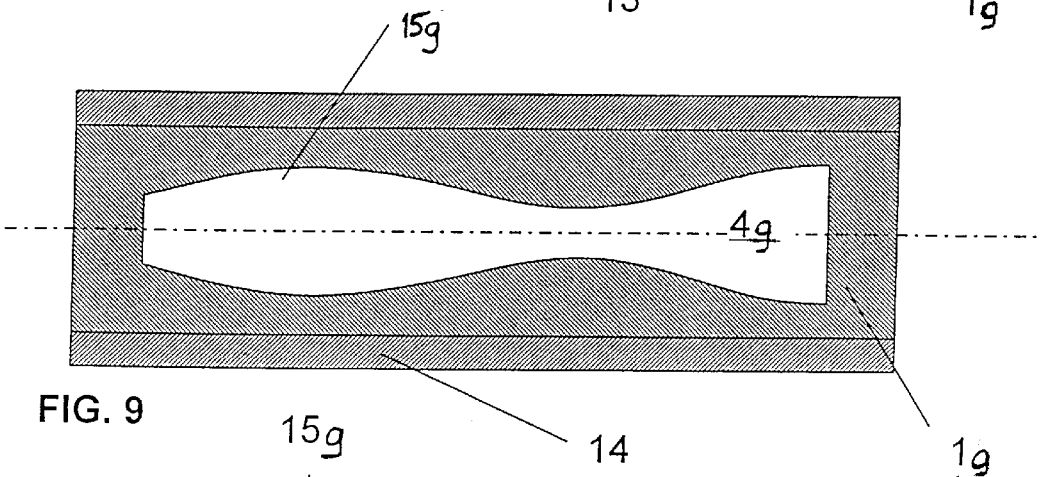

FIG. 8 indicates that the cavity 4*g* in the top working roll 1 is filled with a material 13 with a different strength and/or thermal conductivity. Here, too, as in the case of the other hollow rolls, provision may be made to provide a sleeve 14 serving as a replaceable wearing element. This example is illustrated schematically in FIG. 9.

Figure 10:
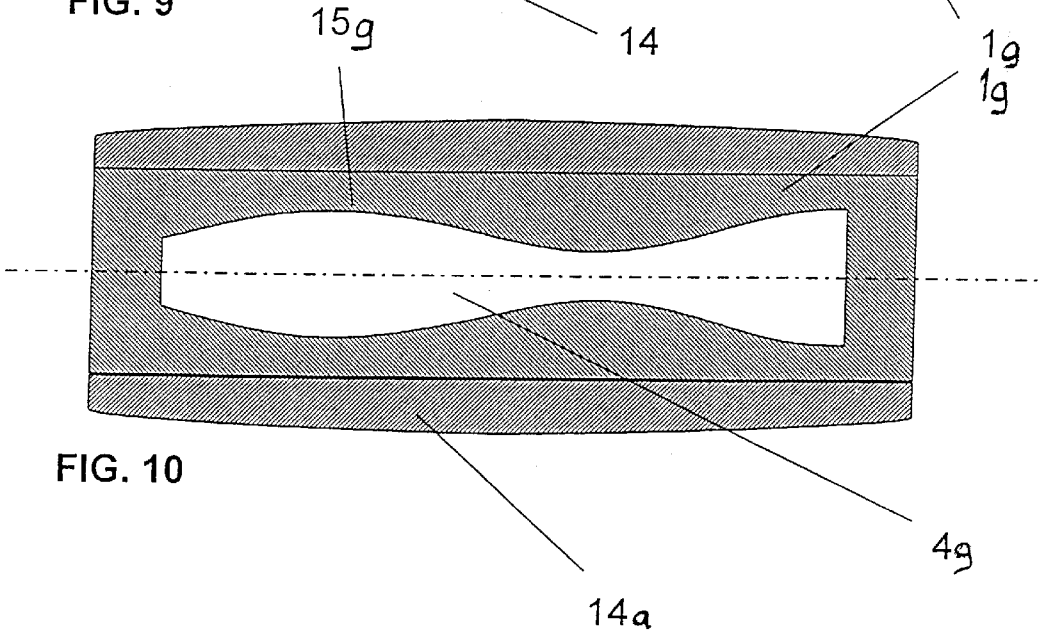

FIG. 10 shows that the roll 1 with a sleeve 14*a* having a symmetrical camber which can be superimposed on the cavity profile. Instead of the sleeve 14*a*, the roll itself may have the symmetrical camber.

Figure 11:
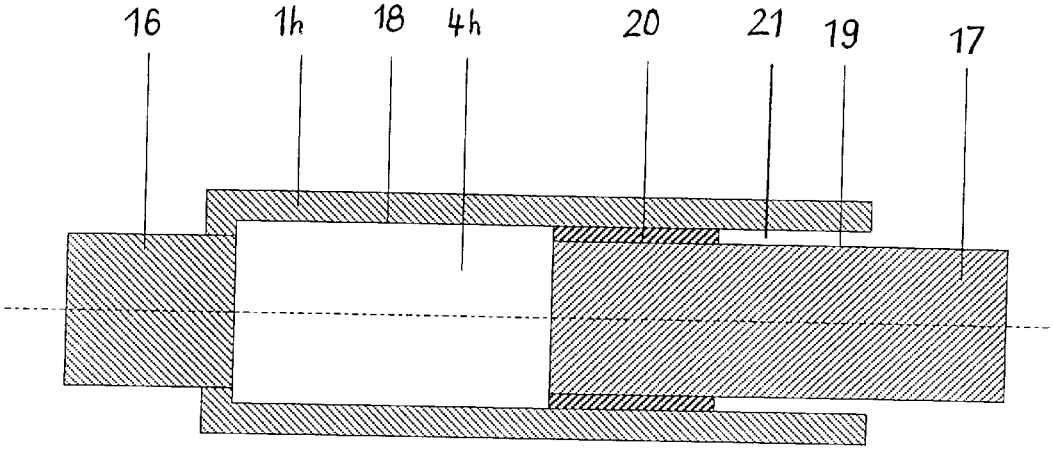

FIG. 11 shows a preferred embodiment of a roll according to the invention. The top working roll 1*h* is designed as a hollow cylinder open at one end. A roll journal 16 is coaxially molded or fitted into the closed end of the top working roll. Another roll journal 17 is coaxially inserted into the open end of the top working roll 1*h* such that a gap 21, which opens toward the open end of the roll, remains between an inner surface 18 of the top working roll 1*h* and an outer surface 19 of the roll journal 17. A support bearing 20 completing the connection between the roll journal 17 and the respective roll 1*h* in the interior of the roll and filling up the space between the roll journal 17 and roll inner surface 18. The cavity 4*h* is formed between the supporting bearing 20 and the closed end of the roll.

Using all the roll shapes illustrated and claimed, it is possible to achieve an asymmetrical bending line, which runs in an S shape in the selected cavity configuration. By displacing the rolls 1, 2 mutually in the direction of the arrow 3, the bending of the rolls which occurs under rolling load can be compensated for by the rolls 1, 2 being mutually displaced, as a result of which the roll gap profile changes. The cavity profile itself does not change as a result of wear of the rolls, so that regrinding of the unloaded roll is easily carried out using simple means. Furthermore, the wear of the roll crown may be taken into account by replacing the roll sleeves 11 or 14 proposed according to the invention.

The invention is not limited by the embodiments described above which are presented as examples only but can be modified in various ways within the scope of protection defined by the appended patent claims.

We claim:

1. A rolling mill, comprising:

first and second supporting rolls rotatably mounted in said rolling mill;

first and second working rolls rotatably mounted in said rolling mill for receiving a material to be worked therebetween and supported by said first and second supporting rolls, said first and second work rolls being mutually axially displaceable, each said first and second working rolls having a roll crown, a longitudinal axis, and a transverse plane intersecting said longitudinal axis at a center of said roll crown, said roll crown comprising an area for receiving the material to be worked;

said first and second working rolls respectively comprising first and second cavities, said first and second cavities being symmetrical about said longitudinal axes and asymmetrical about said transverse planes of said respective first and second work rolls, said first cavity being identical to said second cavity and rotated through 180° with respect to the position of said second cavity.

2. The rolling mill of claim 1, wherein said first and second cavities extend at least under a part of an effective length of said roll crown of said first and second working rolls.

3. The rolling mill of claim 1, wherein said first and second cavities comprise a curved contour at least in a region of an effective length of said roll crown.

4. The rolling mill of claim 1, wherein said first and second cavities are bounded by stepped contours in a region of an effective length of said roll crown.

5. The rolling mill of claim 1, wherein said cavities are filled with a material having a strength and thermal conductivity that differs from a material of said first and second working rolls.

6. The rolling mill of claim 1, further comprising coolant introduced into said first and second cavities in said first and second working rolls.

7. The rolling mill of claim 1, wherein said first and second rolls comprise hollow rolls with replaceable sleeves.

8. The rolling mill of claim 1, wherein said first and second rolls comprise symmetrical cambers.

9. The rolling mill of claim 1, wherein each of said first and second working rolls comprises a hollow cylinder having an open end, a closed end and an inner surface, a fixed roll journal coaxially attached to said closed end and an axially movable journal at least partially inserted in said open end and having an outer surface such that a gap open toward said open end is arranged between said outer surface of said movable roll journal and said inner surface of said hollow cylinder, and a supporting bearing also arranged between said outer surface of said movable roll journal and said inner surface of said hollow cylinder defining a length of said gap between said open end of said hollow cylinder and said support bearing, said first and second cavities being defined by said closed end and said movable journal and support bearing of said respective first and second working rolls.

10. The rolling mill of claim 3, wherein said curved contour comprises a convex section and a concave section.

11. The rolling mill of claim 3, wherein said curved contour extends over a portion of cylindrical first and second working rolls.

12. The rolling mill of claim 3, wherein the curved contour comprises a curve according to a polynomial with an odd exponent.

13. The rolling mill of claim 12, wherein said polynomial comprises a polynomial of third order.

14. The rolling mill as claimed in claim 8, wherein said first and second working rolls each comprise a cylindrical sleeve and a plurality of rings having identical external diameters and different internal diameters, said plural rings being inserted into said cylindrical sleeve element such that they are coaxial with said longitudinal axes of said first and second working rolls.

15. The rolling mill of claim 14, wherein a first material composition of said cylindrical sleeve is different from a second material composition of said plural rings.

16. The rolling mill of claim 7, wherein said replaceable sleeves of said first and second working rolls comprise symmetrical cambers.

17. The rolling mill of claim 16, wherein said first and second cavities extend at least under a part of an effective length of said crown of said first and second working rolls.

18. The rolling mill of claim 16, further comprising coolant introduced into said first and second cavities in said first and second working rolls.

19. The rolling mill of claim 16, wherein said first and second rolls comprise hollow rolls with replaceable sleeves.

20. The rolling mill of claim 19, wherein said replaceable sleeves of said first and second working rolls comprise symmetrical cambers.

21. The rolling mill of claim 16, wherein said first and second rolls comprise symmetrical cambers.

* * * * *